United States Patent [19]

Trumbauer

[11] Patent Number: 4,462,453

[45] **Date of Patent: * Jul. 31, 1984**

[54] CASTING METHODS WITH COMPOSITE MOLDED CORE ASSEMBLY

[75] Inventor: David V. Trumbauer, Denver, Iowa

[73] Assignee: Deere & Company, Moline, Ill.

[ * ] Notice: The portion of the term of this patent subsequent to Jun. 6, 1995 has been disclaimed.

[21] Appl. No.: 45,000

[22] Filed: Jun. 4, 1979

[51] Int. Cl.[3] ..... B22C 9/04

[52] U.S. Cl. ..... 164/32; 164/36

[58] Field of Search ..... 164/36, 32

[56] References Cited

U.S. PATENT DOCUMENTS

| | | | |
|---|---|---|---|
| 3,094,751 | 6/1963 | Horton | 164/36 |
| 3,226,785 | 1/1966 | Moxlow et al. | 164/36 |
| 3,257,692 | 6/1966 | Operhall | 164/36 X |
| 3,259,949 | 7/1966 | Moore | 164/34 |
| 3,339,622 | 9/1967 | Horton | 164/36 |
| 3,410,942 | 11/1968 | Bayer | 264/221 |
| 3,996,991 | 12/1976 | Ugata et al. | 164/35 |
| 4,093,018 | 6/1978 | Trumbauer | 164/34 X |

FOREIGN PATENT DOCUMENTS

| | | |
|---|---|---|
| 1216492 | 5/1966 | Fed. Rep. of Germany . |
| 2453584 | 9/1977 | Fed. Rep. of Germany . |
| 789721 | 1/1958 | United Kingdom . |
| 1219527 | 1/1971 | United Kingdom . |
| 1255907 | 12/1971 | United Kingdom . |
| 1261904 | 1/1972 | United Kingdom . |
| 1516312 | 7/1978 | United Kingdom . |

*Primary Examiner*—Nicholas P. Godici
*Assistant Examiner*—J. Reed Batten, Jr.
*Attorney, Agent, or Firm*—Burns, Doane, Swecker & Mathis

[57] ABSTRACT

A core assembly for use in the casting of molten metal is formed by fabricating a first core, molding a plastic layer around the first core, and molding a second core around the plastic layer. The plastic layer is interlocked with an irregular outer surface of the first core, and the second core is interlocked with an irregular outer surface of the plastic layer. The plastic layer is then dissolved with a suitable solvent prior to placing the core assembly into a mold and molten iron being poured.

24 Claims, 4 Drawing Figures

CASTING METHODS WITH COMPOSITE MOLDED CORE ASSEMBLY

BACKGROUND AND OBJECTS OF THE INVENTION

The present invention relates to foundry and tooling processes and methods.

It is known to form castings such as engine cylinder heads by various foundry techniques in which cores of different shapes are placed within a mold to form voids, such as, for example, water jacket passages and gas ports. In the past, this has required the forming, handling and assembling of numerous cores. A comparatively large number of cores and considerable assembly labor are used in the fabrication of assemblies of this type.

Moreover, conventional core arrangements may require subassembly and pasting or gluing of one or more of the cores together. Such core assemblies are subject to some breakage due to handling, and whenever cores are glued together there are numerous instances in which molten metal flows between the cores and forms fins. When these fins protrude into water jacket passages, they must be removed as they would tend to restrict circulation and interfere with the proper operation of the engine.

Also, in commercial foundries, it is not uncommon for glueing to be performed in such a manner that relatively large amounts of glue remain in hidden or inaccessible areas of the assembled cores. This excess glue acts much as a core would, leaving a void and causing surface imperfections or holes which can necessitate scrapping of the cast piece.

Further disadvantages of conventional core arrangements may include the need for using a large base or positioning core to hold the water jacket cores and port cores in place during core assembly and during pouring.

Another problem associated with conventional cylinder head coring assemblies lies in the need to design the port walls with relatively thick sections in order to allow for proper assembly of the port cores. These thicker than necessary sections have an adverse effect on efficient operation and cooling of the cylinder head.

The majority of the above-described problems were alleviated by the core assembly and method of casting described in U.S. Pat. No. 4,093,018, issued to Trumbauer on June 6, 1978. The patent discloses a casting method wherein a first core is fabricated which has an irregular outer surface, a destructible cellular plastic material is molded around said first core, a second core is molded in an encompassing relation around said plastic layer, with the core assembly then being placed in a mold cavity into which molten metal is introduced. The molten metal destroys the plastic layer and forms the casting.

The search has continued for improved casting methods, particularly in those methods utilizing cellular plastic materials. The presence of a plastic material during casting may result in defects since the destruction of the plastic material with molten metal results in the production of gaseous byproducts which may not always be completely vented from the assembly during the casting process, thus contaminating the molten metal. Defects in the core materials themselves may also be hidden by the plastic layer and would not, therefore, be detected or corrected prior to the initiation of the casting process.

OBJECTS AND SUMMARY OF THE INVENTION

It is therefore an object of the present invention to provide a casting process which obviates the disadvantages of the prior art as discussed above.

It is also an object of the present invention to eliminate or minimize the occurrence of casting defects due to the use of a plastic material to form a core assembly.

It is still further an object of the present invention to eliminate or minimize the presence of gaseous materials in the molten metal during the casting process.

In one aspect of the present invention there is provided a method of casting metal castings comprising the steps of:

forming a composite core assembly by:

fabricating a first core having an irregular outer surface portion;

molding a layer of cellular plastic material around said irregular outer surface portion of said first core, such that an inner surface of said layer intimately contacts and conforms to the configuration of said irregular outer surface portion of said first core to interlock said first core and said plastic layer together, and such that the outer surface of said plastic layer includes an irregular surface portion;

molding a second core in encompassing relation around said irregular outer surface portion of said plastic layer, such that an inner surface of said second core intimately contacts and conforms to the configuration of the irregular outer surface portion of said plastic layer to interlock said second core and said plastic layer together, and such that the outer surface of said second core is of nonconforming shape relative to the outer surface of said plastic layer, whereupon a composite core assembly is formed;

contacting the composite core assembly with a suitable solvent in amounts and for a period of time sufficient to dissolve the cellular plastic material within the composite core assembly;

forming a mold cavity within a pair of mold halves;

inserting said solvent-treated core assembly as an integral unit within one of said mold halves;

closing said mold halves together; and introducing molten metal into said cavity to form said casting.

In another aspect of the present invention there is provided a method of forming a core assembly comprising the steps of:

fabricating a first core having an irregular outer surface portion;

inserting said first core into a first mold and molding a layer of cellular plastic material in encompassing relation around said irregular outer surface portion of said first core such that an inner surface of said plastic layer intimately contacts and conforms to the configuration of said irregular outer surface portion of said first core to interlock said first core and said plastic layer together, and such that the outer surface of said plastic layer includes an irregular surface portion;

inserting as a unit said first core and said molded plastic layer into a second mold having a cavity which defines a surface of nonconforming shape relative to the outer surface of said plastic layer, and molding a second core in encompassing relation around said irregular outer surface portion of said plastic layer such that an inner surface of said second core intimately contacts and conforms to the configuration of the irregular outer surface portion of said plastic layer to interlock said second core and said plastic layer together, whereupon a core assembly is formed; and contacting the core assembly with a solvent in amounts and for a period of time sufficient to dissolve the cellular plastic material within the assembly.

In still another aspect of the present invention there is provided a method of forming a core assembly for use in the casting of molten metal by fabricating a first core having an irregular outer surface portion, molding a layer of plastic material around said irregular outer surface portion such that the inner surface of said plastic layer is in interlocking relationship with said irregular outer surface and such that the outer surface of said plastic layer includes an irregular outer surface, and molding a second core in an encompassing and interlocking relationship around said irregular outer surface of said plastic layer wherein the improvement comprises:

contacting the core assembly with a suitable solvent in amounts and for a period of time sufficient to dissolve the plastic material within the core assembly.

In yet another aspect of the present invention there is provided a core assembly produced by a method comprising the steps of:

fabricating a first core having an irregular outer surface portion;

inserting said first core into a first mold and molding a layer of cellular plastic material in encompassing relation around said irregular outer surface portion of said first core such that an inner surface of said plastic layer intimately contacts and conforms to the configuration of said irregular outer surface portion of said first core to interlock said first core and said plastic layer together, and such that the outer surface of said plastic layer includes an irregular surface portion;

inserting as a unit said first core and said molded plastic layer into a second mold having a cavity which defines a surface of nonconforming shape relative to the outer surface of said plastic layer, and molding a second core in encompassing relation around said irregular outer surface portion of said plastic layer such that an inner surface of said second core intimately contacts and conforms to the configuration of the irregular outer surface portion of said plastic layer to interlock said second core and said plastic layer together, whereupon a core assembly is formed; and contacting the core assembly with a solvent in amounts and for a period of time sufficient to dissolve the cellular plastic material within the assembly.

BRIEF DESCRIPTION OF THE DRAWINGS

In describing the invention, reference will be made to a preferred embodiment shown in the appended drawings in which.

DETAILED DESCRIPTION OF THE INVENTION

Figure 1:
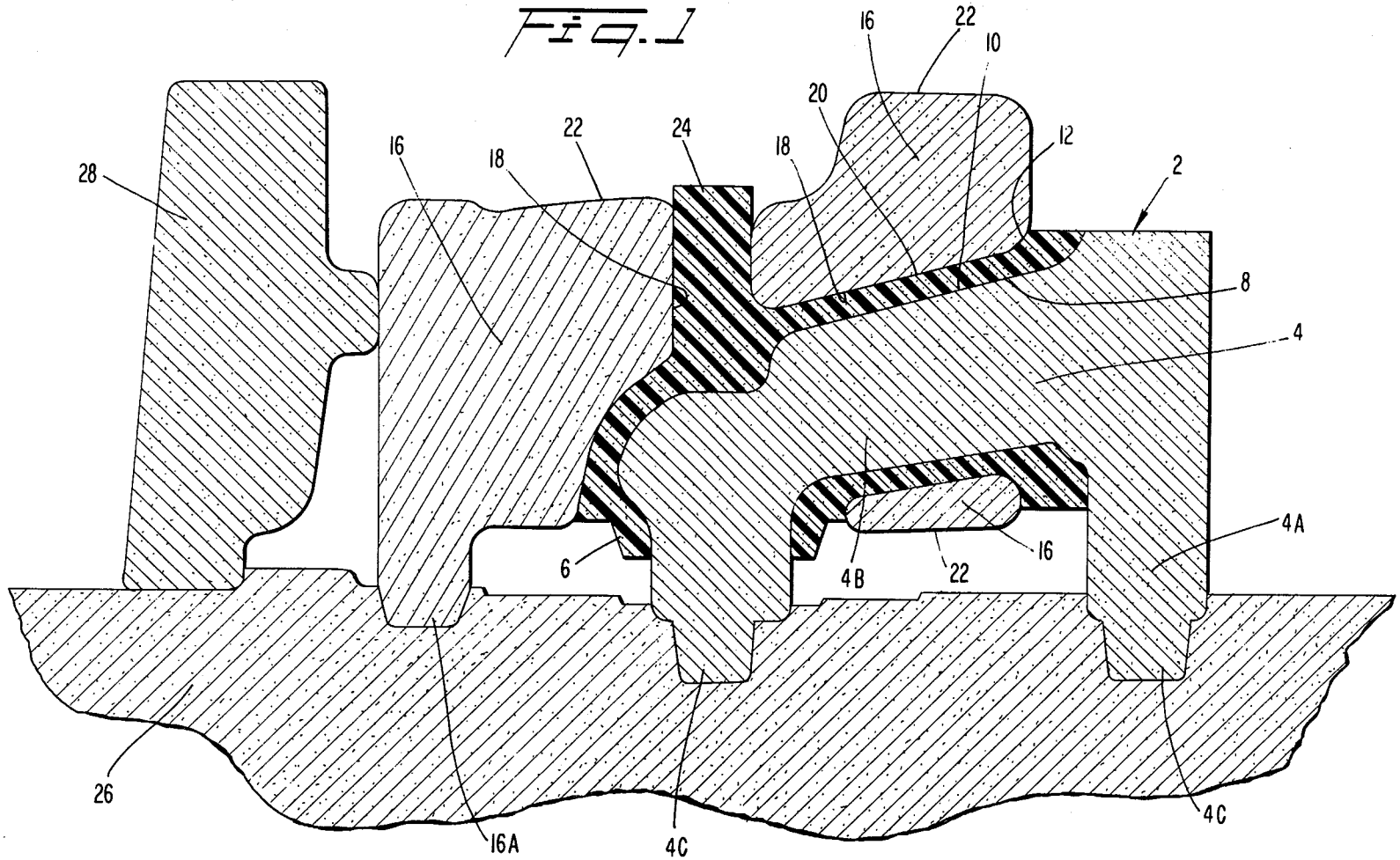
FIG. 1 is a cross-sectional view depicting a core assembly which may be used in the present invention to form a cylinder head of an in-line, six-cylinder internal combustion engine of the overhead valve type.
Figure 2:
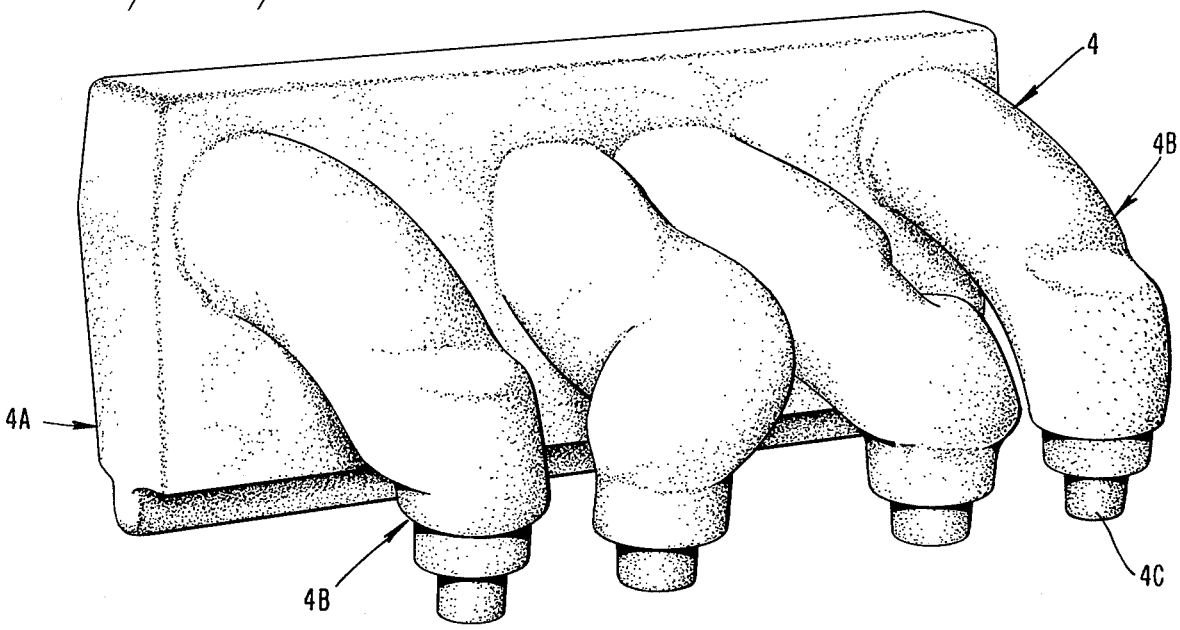
FIGS. 2–4 are perspective views depicting various stages in the fabrication of the core assembly of FIG. 1.
Figure 3:
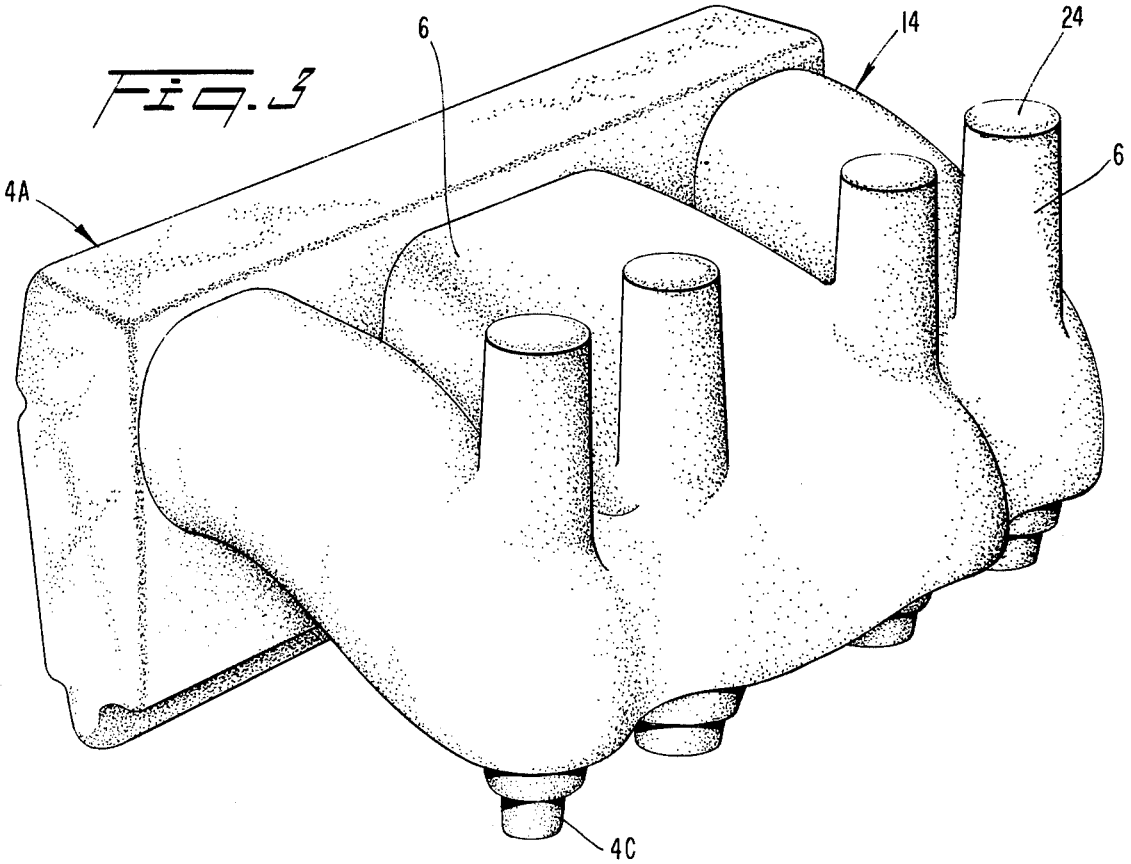
Figure 4:
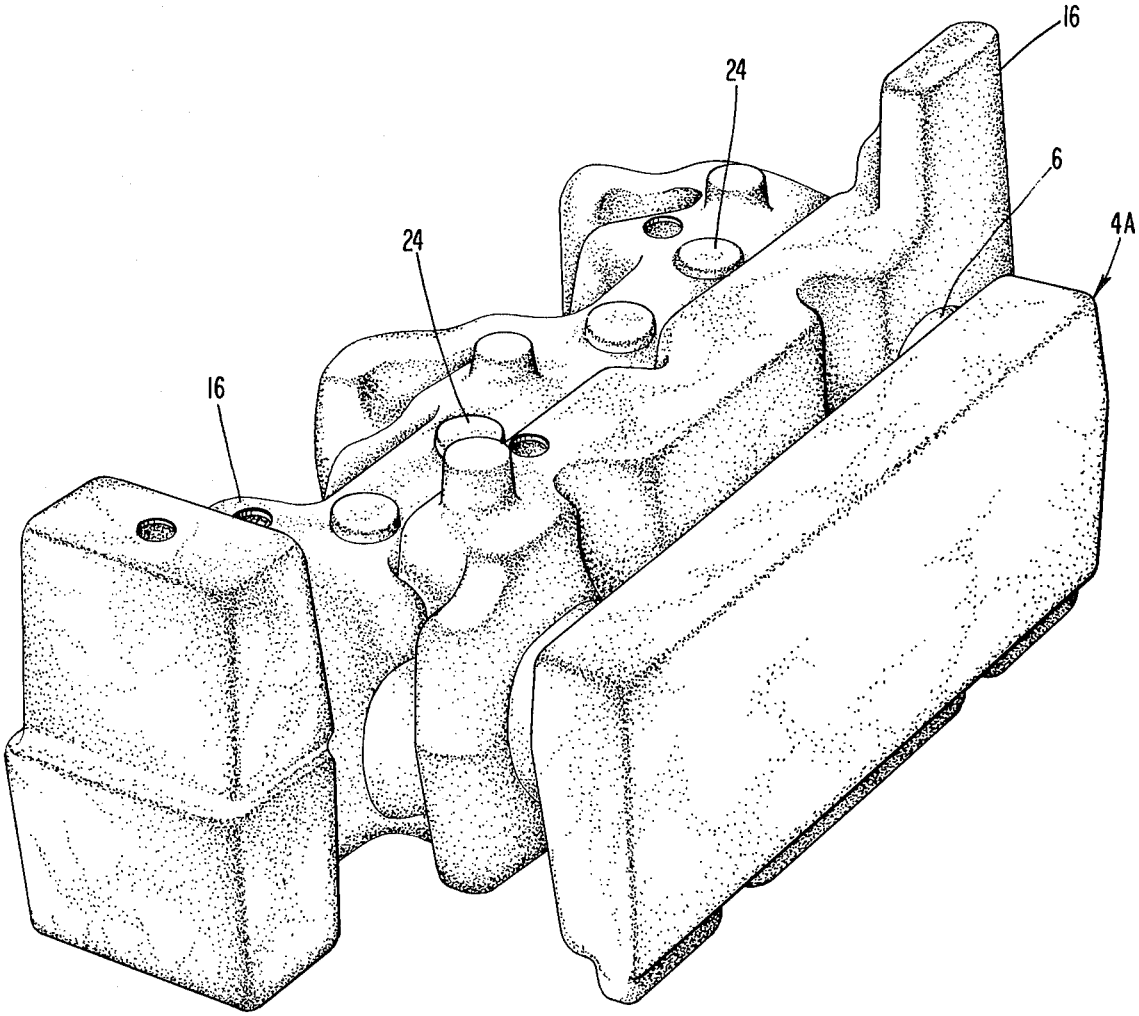

A preferred form of a core assembly which may be used in the casting process of the present invention to produce a cylinder head of an in-line, six-cylinder, internal combustion engine is depicted in FIGS. 1 and 4. The core assembly 2 comprises a first, or inner, core 4 (FIGS. 1 and 2). The inner core 4 includes port extensions 4B projecting downwardly and laterally from the base portion, and generally coplanar positioning portions 4C at the ends of the base portion and port extensions 4B. Fabrication of the inner core is carried out in any suitable manner. For instance, the inner core can be molded of silica sand and a suitable binder such as a phenolic base and/or modified phenolic base resin by conventional techniques.

A layer of plastic material 6 is then formed around a portion of the inner core, i.e., the port extension 4B of the inner core 4. The plastic material may comprise any suitable low temperature fusible substance, such as a thermoplastic resinous material or any other material such as a cellular plastic material which is capable of being dissolved by a suitable solvent. Cellular plastic materials are the preferred plastic material for use in the invention. Among the materials which have been found satisfactory are polystyrene and resinous polymerized derivatives of methacrylic acid.

Various types of cellular plastic materials which have been found to be suitable for use in casting operations are described in U.S. Pat. No. 3,374,827, issued to Schebler on Mar. 26, 1968, and U.S. Pat. No. 3,496,989, issued to Paoli on Feb. 24, 1970. The Schebler patent discusses the use of polystyrene as a spacer to be inserted between cemented cores. The Paoli patent discloses the use of polystyrene as a chaplet to abut and position cores in place, and also as a pattern for full mold techniques with a core embedded therein.

The plastic layer 6 can be molded in place around the first core 4 by suitable means such as by placing the first core 4 into a molding machine. A plastic material such as partially pre-expanded polystyrene pellets can then be applied to the mold and fully expanded around the first core 4 by a suitable method such as a steam expansion step so as to form a plastic layer whose inner surface 8 intimately contacts and conforms to the configuration of the outer surface 10 of the first core. The outer surface 12 of the molded plastic layer is configured in accordance with the desired shape of the cylinder head.

The plastic layer 6 completely surrounds or encompasses a portion of the first core 4 and, due to the irregular surface configuration of the first core 4, is permanently mounted thereon, i.e., it cannot be removed therefrom in any direction.

The first core 4 and the plastic layer 6 form a composite core subassembly 14 which can be handled as a one-piece unit. If required, the composite subassembly can be dried by suitable means, such as, for example, in a microwave oven, to remove any residual water from the steam expansion step.

Thereafter, a second or outer core 16, which constitutes a cooling jacket core in the preferred embodiment, is formed around a portion of the composite subassembly 14 so as to intimately contact and conform to the configuration thereof (FIGS. 1 and 4). This may be accomplished by placing the subassembly 14 into a second mold or corebox and core blower and blowing a suitable core composition, e.g., the aforementioned silica sand and binder, therearound. The outer core 16 is thus blown in place in overlying relation to a portion of the plastic layer 6 to encompass or surround the layer. An inner surface 18 of the outer core 16 therefore intimately contacts and conforms to the configuration of the outer surface 20 of the plastic layer 6. The outer surface 22 of the outer core 16 is configured in accordance with the desired ultimate shape of the cooling jacket passage. Portions of the cooling jacket passages are formed by molding the outer core around solid upright post portions 24 of the plastic layer forming the valve guide bosses of the cylinder head. The outer core 16 also includes integral positioning parts 16A.

Due to the irregular configuration of the sub-assembly 14, the outer core 16 is permanently secured thereto. That is, the outer core 16 cannot be removed in any direction.

The inner core 4, together with the molded-in-place plastic layer 6 and the molded-in-place outer core 16 form a core assembly 2. The core assembly is then treated with a suitable solvent to dissolve the plastic material, leaving a void space where the material had previously been positioned.

The plastic material may be contacted with the solvent in any suitable manner as long as the solvent is able to effectively dissolve the plastic material. A preferred method, however, consists of immersing the core assembly in a bath containing the solvent for a period of time necessary to completely dissolve the plastic material.

The choice of the particular solvent which is employed is not critical. The solvent should preferably, however, be able to totally dissolve the plastic material which is employed in the core assembly in a desirably brief period of time. While the length of time it takes to dissolve the material is not critical, any time which can be saved during the dissolving step correspondingly decreases the overall length of time for the formation of the core assembly and thus the time of the overall casting process. Naturally the solvent which will be most desirable or effective in a given circumstance will vary depending upon the plastic material employed. The choice of a suitable solvent is well within the skill of the artisan.

For example, in the case of expanded polystyrene, aromatic and halogenated hydrocarbon solvents have been found to dissolve the polystyrene. Exemplary solvents which have been found to be suitable to dissolve polystyrene include benzene, toluene, and 1-1-1 trichloroethane, with 1-1-1 trichloroethane being preferred.

Upon contacting a solvent such as 1-1-1 trichloroethane, the expanded polystyrene rapidly goes into solution as evidenced by a vigorous bubbling action. Normally only thirty seconds or so are required for the polystyrene to completely dissolve. However, the time required for various types of plastics to dissolve will depend upon the characteristics of the specific plastic material and the solvent employed.

It has been found that the solvent solution will penetrate the surface of the cores employed during the treatment step. Advantageously, a layer of carbonaceous material is deposited upon the outer layer of material (e.g., sand) in the cores. The need for refractory-type core washes is thus reduced or eliminated since the outer surface of the core is effectively sealed by the deposited layer of material. The permeability of the core is drastically reduced such that any gaseous materials which evolve during the casting process do not penetrate the core itself but instead are removed through appropriate voids within the assembly. Inclusions and voids within the castings formed from the assembly are greatly reduced or eliminated.

After the plastic material has been completely dissolved, the core assembly is then removed from contact with the solvent. Such a removal step may consist simply of removing the assembly from the solvent bath and permitting the solvent to drain from the assembly.

The solvent-treated core assembly is preferably dried to vaporize and remove any residual solvent which may be present. The assembly may be dried by any suitable method, such as, for example, by being placed in a conventionally heated convection drying oven for a sufficient period of time. The assembly may also be dried under a vacuum or reduced pressure to vaporize the solvent without the use of heat.

The solvent-treated and dried assembly 2 is then inserted directly into a pre-formed cavity in the green sand 26 of the drag half of a mold. The core locating portions 4C, 16A of the cores 4, 16 function to support the core assembly 2 as a whole within the mold. The end 4A of the inner core 4 is formed so as to engage the green sand 26 to provide support for one side of the core assembly 2. Subsequent to the alignment and installation of the core assembly 2 in the drag portion, conventional cores such as 28 may be installed around the core assembly.

A cope portion of the mold is then positioned over the drag portion and the portions closed together, whereafter a molten iron charge is poured into the mold cavity to form the cylinder head. The metal forms port and jacket walls of the cylinder head in accordance with the configuration of the outer surface 10 of the inner and outer cores 4, 16.

Although the present invention has been described with reference to a composite assembly of two cores and an intermediate layer of expanded cellular plastic material, it will be understood by those skilled in the art that the core assembly may include three or more cores, each core being formed onto and spaced from the next inner core by a layer of cellular plastic material. Thus, for example, another layer of cellular plastic material, if desired, could be formed around the surface, of core 16 and another core molded around that plastic surface. The composite assembly may thus contain any number of layers of cores and plastic material as deemed feasible.

Such changes in the form of the core assembly do not have any significant effect upon the solvent treatment of the assembly. The time within which complete solvation of the plastic material is achieved may be extended, however, if a greater volume of plastic material is used.

It will also be understood that the present invention is applicable to the production of any kind of metal casting. While it has been described above with reference to the casting of a cylinder head and appears to be especially useful in this area due to the intricacy of the core assemblies needed for the casting, the present invention may be utilized for the production of other types of castings using any type of metal.

The invention is additionally illustrated in connection with the following Example which is to be considered as illustrative of the present invention. It should be understood, however, that the invention is not limited to the specific details of the Example.

EXAMPLE

A first core 4 is formed in a mold or corebox from silica sand and a phenolic base and/or modified phenolic base resin binder compound. The first core 4 is then placed into a mold or corebox which is thereafter filled with partially expanded polystyrene pellets. Steam is applied to this mold to fully expand the pellets to form a plastic layer 6 therearound in intimate contact with the first core 4. The composite core subassembly defined by the first core and the polystyrene layer is dried in a microwave oven until residual water from the steam expansion step is evaporated.

The subassembly is thereafter placed into another mold or corebox which is filled with silica sand and phenolicisocyanate binder activated by a triethylamine or dimethylethylamine catalyst to form a second core 16 around the polystyrene layer of the subassembly in intimate contact therewith.

The resulting core assembly is then immersed in a solvent bath of 1-1-1 trichloroethane whereupon the polystyrene layer dissolves completely as evidenced by vigorous bubbling which occurs for several seconds.

The solvent-treated core assembly is then dried under a reduced pressure of nineteen inches of mercury to vaporize and remove any residual 1-1-1 trichloroethane solvent which may be present.

The solvent-treated and dried core assembly is then placed in the drag portion of a mold assembly containing foundry sand. Other conventional core assembly components are placed about the core assembly to form a composite mold assembly suitable for forming a casting of a cylinder head for a six cylinder engine. The cope portion of the mold assembly is combined with the drag portion in a conventional manner. A casting is made using this composite mold assembly using conventional techniques. The interior of the resulting casting is smooth-surfaced, free of pits and fins, and is suitable for use as a cylinder head.

While the invention has been described in connection with a preferred embodiment thereof, it is to be understood that the present disclosure is illustrative rather than restrictive and further modifications may be resorted to without departing from the spirit of the invention or the scope of the claims.

What is claimed is:

1. In a method of casting metal castings comprising the steps of:

forming a composite core assembly by:

fabricating a first core having an irregular outer surface portion;

molding a layer of cellular plastic material around said irregular outer surface portion of said first core, such that an inner surface of said layer intimately contacts and conforms to the configuration of said irregular outer surface portion of said first core to interlock said first core and said plastic layer together, and such that the outer surface of said plastic layer includes an irregular surface portion;

molding a second core in encompassing relation around said irregular outer surface portion of said plastic layer, such that an inner surface of said second core intimately contacts and conforms to the configuration of the irregular outer surface portion of said plastic layer to interlock said second core and said plastic layer together, and such that the outer surface of said second core is of nonconforming shape relative to the outer surface of said plastic layer, whereupon a composite core assembly is formed;

forming a mold cavity within a pair of mold halves;

inserting said core assembly as an integral unit within one of said mold halves;

closing said mold halves together; and introducing molten metal into said cavity to form said casting, the improvement comprising contacting the composite core assembly with a suitable solvent in amounts and for a time sufficient to dissolve the cellular plastic material within the composite core assembly prior to inserting said core assembly as a unit within one of said mold halves.

2. In the method according to claim 1 wherein said step of molding a plastic layer comprises inserting said first core into a mold, applying thermoplastic resinous pellets around said core and expanding said pellets around said first core.

3. In the method according to claim 2 wherein said step of applying resinous pellets comprises applying pre-expanded polystyrene pellets.

4. In the method according to claim 3 wherein said solvent comprises 1-1-1 trichloroethane.

5. In the method according to claim 1 wherein the core assembly is contacted with the solvent by immersing the core assembly in a solvent bath.

6. In the method according to claim 5 wherein the core assembly is removed from the solvent bath and dried to remove any residual solvent.

7. In the method according to claim 6 wherein said core assembly is dried under reduced pressure.

8. In a method of forming a core assembly comprising the steps of:

fabricating a first core having an irregular outer surface portion;

inserting said first core into a first mold and molding a layer of cellular plastic material in encompassing relation around said irregular outer surface portion of said first core such that an inner surface of said plastic layer intimately contacts and conforms to the configuration of said irregular outer surface portion of said first core to interlock said first core and said plastic layer together, and such that the outer surface of said plastic layer includes an irregular surface portion;

inserting as a unit said first core and said molded plastic layer into a second mold having a cavity which defines a surface of nonconforming shape relative to the outer surface of said plastic layer, and molding a second core in encompassing relation around said irregular outer surface portion of said plastic layer such that an inner surface of said second core intimately contacts and conforms to the configuration of the irregular outer surface portion of said plastic layer to interlock said second core and said plastic layer together, whereupon a core assembly is formed; and removing the cellular plastic material within the assembly, the improvement comprising contacting the core assembly with a solvent in amounts and for a period of time sufficient to dissolve the cellular plastic material within the assembly.

9. In the method according to claim 8 wherein said step of molding a plastic layer comprises inserting said first core into a mold, applying thermoplastic resinous pellets around said first core and expanding said pellets around said first core.

10. In the method according to claim 9 wherein said step of applying resinous pellets comprises applying pre-expanded polystyrene pellets.

11. In the method according to claim 10 wherein said solvent comprises 1-1-1 trichloroethane.

12. In the method according to claim 8 wherein the core assembly is contacted with the solvent by immersing the core assembly in a solvent bath.

13. In the method according to claim 12 wherein the core assembly is removed from the solvent bath and dried to remove any residual solvent.

14. In the method according to claim 13 wherein said core assembly is dried under reduced pressure.

15. In a method of forming a core assembly for use in the casting of molten metal by fabricating a first core having an irregular outer surface portion, molding a layer of plastic material around said irregular outer surface portion such that the inner surface of said plastic layer is in interlocking relationship with the irregular outer surface of said first core and such that the outer surface of said plastic layer includes an irregular outer surface, and molding a second core in an encompassing and interlocking relationship around said irregular outer surface of said plastic layer, the improvement comprising:

contacting the core assembly with a suitable solvent in amounts and for a period of time sufficient to dissolve the plastic material within the core assembly.

16. In the method of claim 15 wherein the core assembly is thereafter dried under reduced pressure to remove residual solvent.

17. In a method of casting metal castings comprising the steps of:

fabricating a composite core assembly by molding a destructible layer of cellular plastic material such that a surface of said plastic layer includes an irregular surface portion; and forming a core in encompassing relation around said irregular surface portion of said plastic layer such that a surface of said core intimately contacts and conforms to the configuration of the irregular surface portion of said plastic layer to interlock said core and said plastic layer together;

forming a mold cavity within a pair of mold sections;

inserting said core assembly as an integral unit within one of said mold sections;

securing said mold sections together; and introducing molten metal into said cavity to form said casting, the improvement comprising contacting the composite core assembly with a suitable solvent in amounts and for a time sufficient to dissolve the cellular plastic material within the composite core assembly prior to inserting said core assembly as a unit within one of said mold sections.

18. In the method according to claim 17, wherein said step of molding a plastic layer comprises fabricating an initial core having an irregular surface portion, inserting said initial core into a corebox, applying thermoplastic resinous pellets around said initial core, and expanding said pellets around said initial core such that a surface of said plastic layer intimately contacts and conforms to said irregular surface portion of said initial core.

19. In the method according to claim 18, wherein said step of applying resinous pellets comprises applying pre-expanded polystyrene pellets.

20. In the method according to claim 17, wherein the core is formed by blowing a mixture of sand and binder around said surface portion of said plastic layer.

21. In the method according to claim 17 wherein said solvent comprises 1-1-1 trichloroethane.

22. A method according to claim 17 wherein the core assembly is contacted with the solvent by immersing the core assembly in a solvent bath, the core assembly is removed from the solvent bath and dried under reduced pressure to remove any residual solvent.

23. In a method of forming a core assembly comprising the steps of:

fabricating a first core of cellular plastic material having an irregular outer surface portion;

inserting as a unit said first core into a mold having a cavity which defines a surface of nonconforming shape relative to the outer surface of said plastic layer, and molding a sand core in encompassing relation around said irregular outer surface portion of said plastic layer such that an inner surface of said sand core intimately contacts and conforms to the configuration of the irregular outer surface portion of said plastic layer to interlock said sand core and said plastic layer together, whereupon a core assembly is formed; and removing the cellular plastic material within the assembly, the improvement comprising:

contacting the core assembly with a solvent in amounts and for a period of time sufficient to dissolve the cellular plastic material within the assembly.

24. The method according to claim 23 wherein said cellular plastic material comprises expanded polystyrene, said solvent comprises 1-1-1 trichloroethane and wherein the expanded polystyrene is removed from the core assembly by immersing the core assembly in a 1-1-1 trichloroethane solvent bath, the core assembly is removed therefrom and dried under reduced pressure to remove any residual 1-1-1 trichloroethane solvent.

* * * * *